US009751108B2

(12) United States Patent
Shih et al.

(10) Patent No.: US 9,751,108 B2
(45) Date of Patent: Sep. 5, 2017

(54) EXTENDED RANGE ULTRASOUND TRANSDUCER

(71) Applicant: Texas Instruments Incorporated, Dallas, TX (US)

(72) Inventors: Wei-Yan Shih, Plano, TX (US); Xiaochen Xu, Coppell, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 222 days.

(21) Appl. No.: 14/814,542

(22) Filed: Jul. 31, 2015

(65) Prior Publication Data

US 2017/0028439 A1 Feb. 2, 2017

(51) Int. Cl.
*B06B 1/02* (2006.01)
*B06B 3/00* (2006.01)
*B06B 1/06* (2006.01)

(52) U.S. Cl.
CPC ..... *B06B 1/0629* (2013.01); *B06B 1/0292* (2013.01)

(58) Field of Classification Search
CPC ..... B06B 1/0292; B06B 1/0629
See application file for complete search history.

(56) References Cited

U.S. PATENT DOCUMENTS 6,865,140 B2 3/2005 Thomenius et al.
2008/0229835 A1* 9/2008 Davidsen ..... B06B 1/0622 73/629
2012/0319535 A1 12/2012 Dausch
2013/0261467 A1* 10/2013 Dausch ..... A61B 8/12 600/466
2014/0355376 A1* 12/2014 Schneider ..... G01S 7/56 367/7
2016/0351292 A1* 12/2016 Toth ..... A61B 5/6876
2017/0028439 A1* 2/2017 Shih ..... B06B 1/0292

FOREIGN PATENT DOCUMENTS

JP WO 2017023874 A1 * 2/2017 ..... B06B 1/0292
WO 2012127360 A2 9/2012

OTHER PUBLICATIONS

International Search Report and Written Opinion for PCT/US2016/045055 mailed Oct. 27, 2016.

* cited by examiner

*Primary Examiner* — Daniel Pihulic
(74) *Attorney, Agent, or Firm* — Michael A. Davis, Jr.; Charles A. Brill; Frank D. Cimino

(57) ABSTRACT

An ultrasonic transducer. The ultrasonic transducer has an interposer having electrical connectivity contacts. The ultrasonic transducer also has an ultrasonic receiver, comprising an array of receiving elements, physically fixed relative to the interposer and coupled to electrically communicate with electrical connectivity contacts of the interposer. The ultrasonic transducer also has at least one ultrasonic transmitter, separate from the ultrasonic receiver, physically fixed relative to the interposer and coupled to electrically communicate with electrical connectivity contacts of the interposer.

22 Claims, 8 Drawing Sheets

EXTENDED RANGE ULTRASOUND TRANSDUCER

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The preferred embodiments relate to ultrasound transducers and, more particularly, to combined discrete transmitter circuitry with a separate ultrasonic transducer receiver array.

Ultrasound transducers are known in the art for transmitting ultrasound waves and detecting a reflection or echo of the transmitted wave. Such devices are also sometimes referred to as ultrasound or ultrasonic transducers or transceivers. Ultrasound transducers have myriad uses, including consumer devices, vehicle safety, and medical diagnostics. In these and other fields, signals detected by the transducer may be processed to determine distance which may be further combined with directional or area processing to determine shape as well as aspects in connection with two and three dimensional processing, including image processing.

A micromachined ultrasonic transducer (MUT) array is commonly used in the prior art as an ultrasound transducer, that is, to perform both the transmission of ultrasonic sounds and the detection of the sound echo. Such an array is typically formed using semiconductor processing, whereby an array of micromachined mechanical elements is created relative to the semiconductor substrate. Each array element has a same construction but is separately excitable to transmit a signal and separately readable to detect the signal echo. The prior art includes numerous techniques for forming numerous types of elements, where two common element examples are piezoelectric or capacitive, the former used for a so-called piezoelectric micromachined ultrasonic transducer (pMUT) and the latter used for a so-called capacitive micromachined ultrasonic transducer (cMUT). In general, the pMUT array elements function in response to the known nature of piezoelectric materials combined sometimes with a thin film membrane, which collectively generate electricity from applied mechanical strain and, in a reversible process, generate a mechanical strain from applied electricity. Also in general, the cMUT array elements function in response to the known nature of capacitive structure and in combination with an associated membrane, so the elements generate an alternating electrical signal from a change in capacitance caused by vibration of the membrane and, in a reversible process, generate vibration of the membrane from an applied alternating signal across the capacitor.

While the above and related approaches have served various needs in the prior art, they also provide various drawbacks. For example, acoustic power is a function of the product of pressure, area, and velocity, so the membrane used in a MUT may limit the transmission power because of limitations in sustaining pressure, a relatively small areal coverage on part of the transducer surface, and also due to reduced velocity form non-uniformities across the membrane. As another example, the number of elements in the MUT array are often increased so as to achieve greater resolution or other performance, and wire bonding, flex cable, or the like are often implemented for interconnectivity to each element, so a large number of elements (e.g., 50×50 or above) creates considerable complexity and cost in a wire bundle or cable so as to electrically communicate with all elements.

Given the preceding, the present inventors seek to improve upon the prior art, as further detailed below.

BRIEF SUMMARY OF THE INVENTION

In a preferred embodiment, there is an ultrasonic transducer. The ultrasonic transducer has an interposer having electrical connectivity contacts. The ultrasonic transducer also has an ultrasonic receiver, comprising an array of receiving elements, physically fixed relative to the interposer and coupled to electrically communicate with electrical connectivity contacts of the interposer. The ultrasonic transducer also has at least one ultrasonic transmitter, separate from the ultrasonic receiver, physically fixed relative to the interposer and coupled to electrically communicate with electrical connectivity contacts of the interposer.

Numerous other inventive aspects are also disclosed and claimed.

DETAILED DESCRIPTION OF EMBODIMENTS

Figure 1:
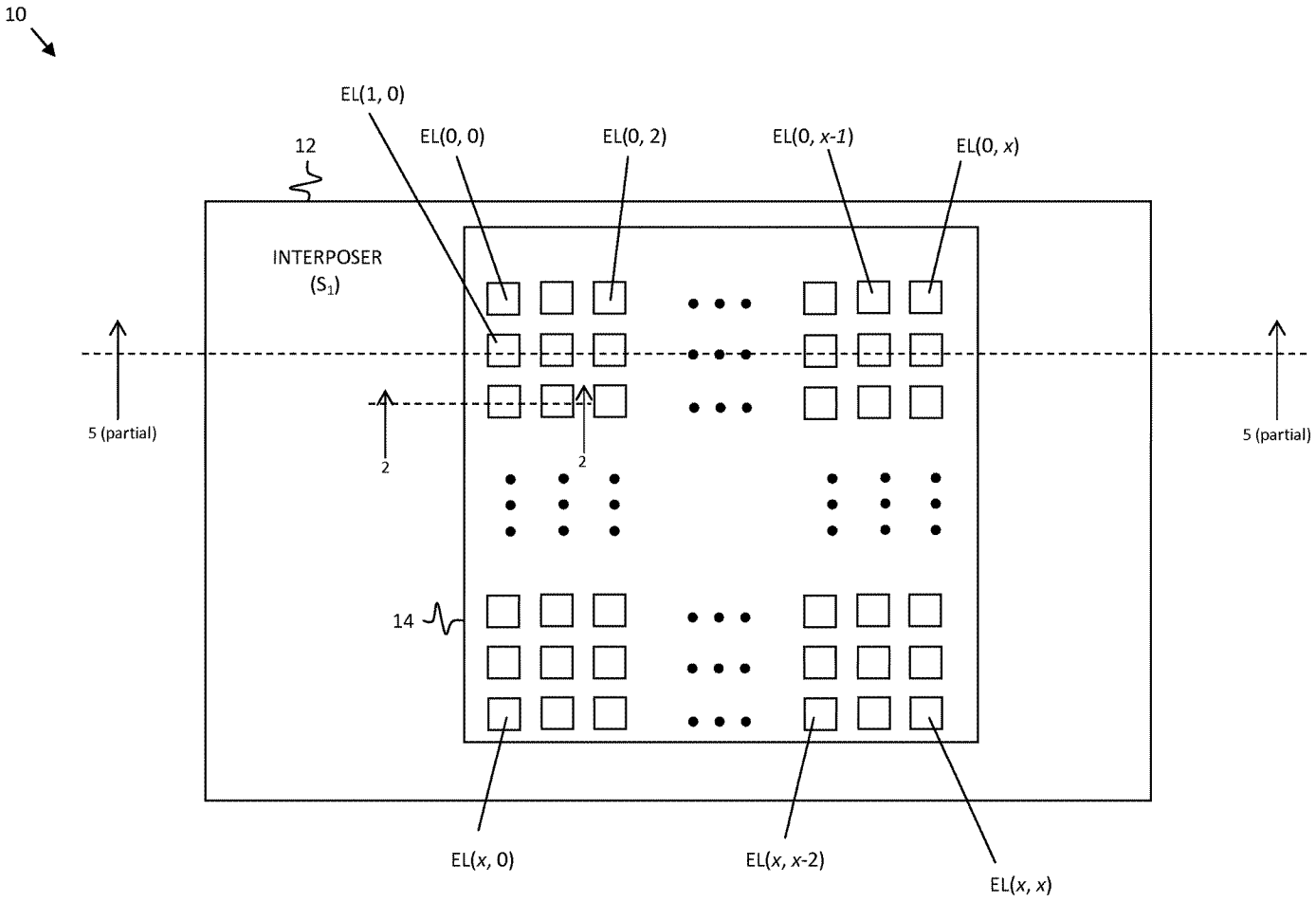
FIG. 1 illustrates an electrical block diagram of a first side of an ultrasound transducer per the preferred embodiments.

FIG. 1 illustrates an electrical block diagram of an ultrasound transducer 10 per the preferred embodiments. As one skilled in the art will readily understand, various matters are known in the transducer art and, therefore, such matters may be used to supplement the block and functional description of this document. The preferred embodiments, therefore, are described with this understanding and with a concentration on the combination of certain technologies and layouts so as to achieve an overall ultrasound transducer device that provides advantages over the prior art.

Figure 3:
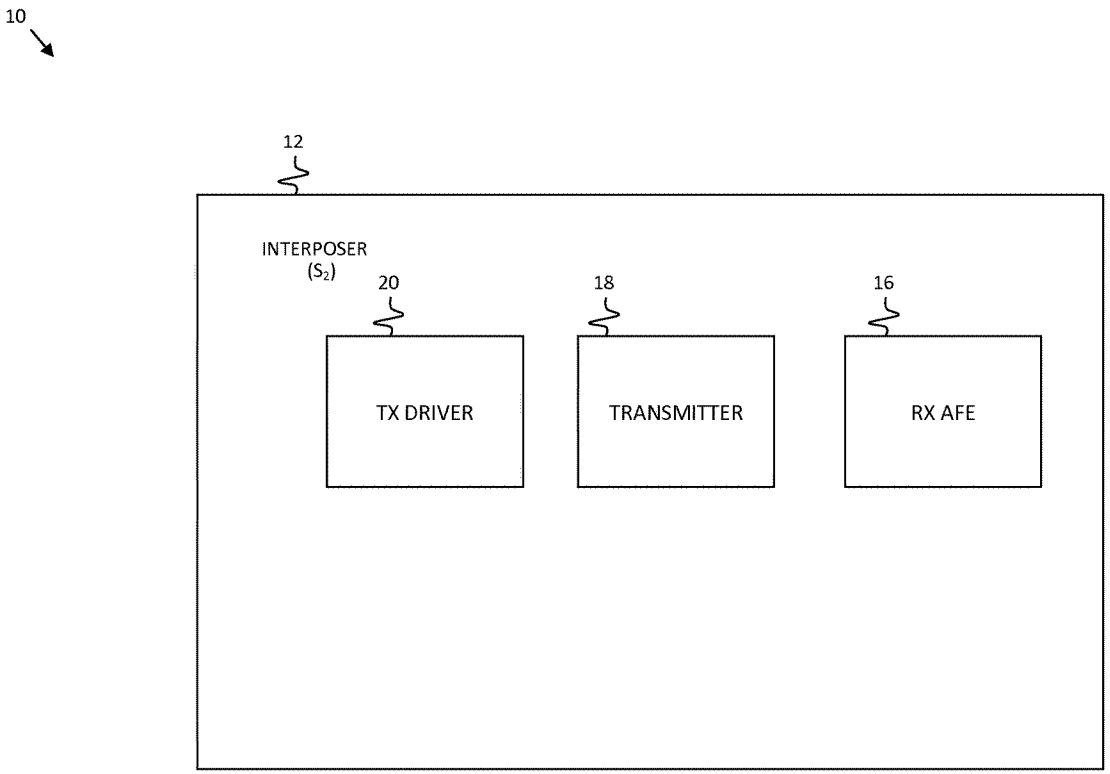
FIG. 3 illustrates an electrical block diagram of a second side of the ultrasound transducer of FIG. 1.
Figure 5:
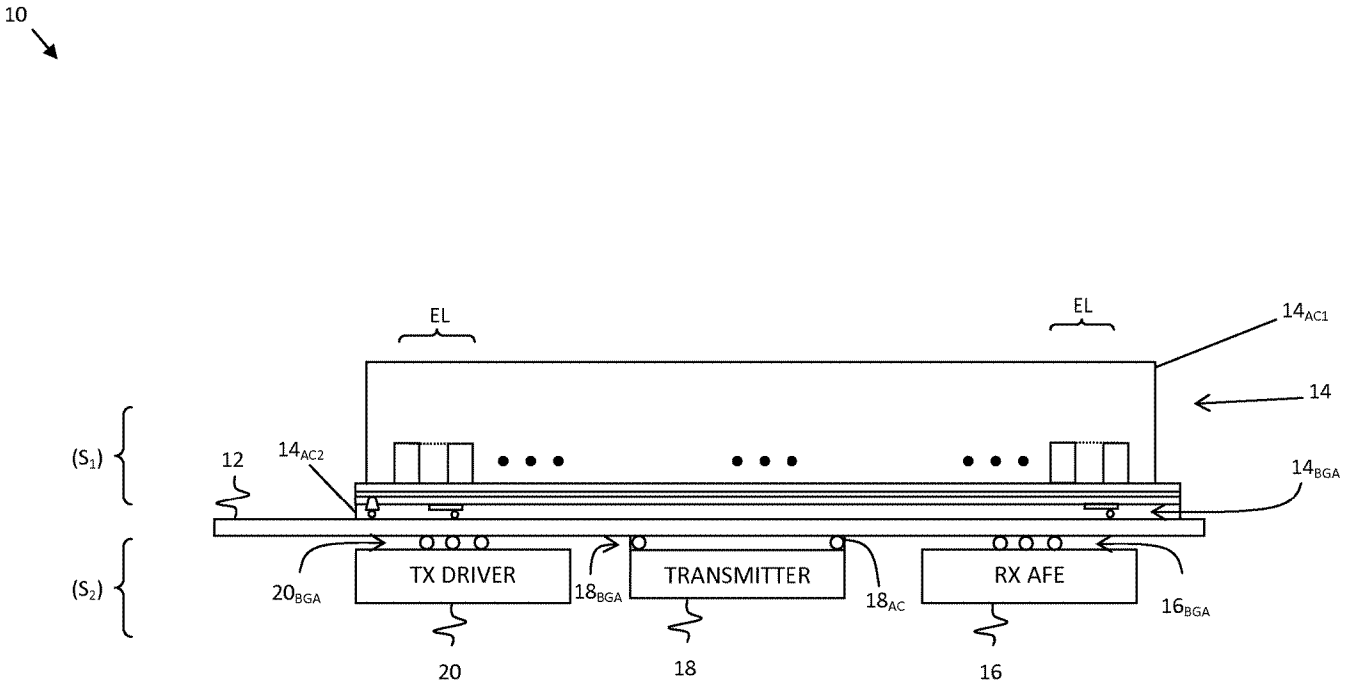
FIG. 5 illustrates a cross-sectional view of an electrical block diagram of the ultrasound transducer of FIGS. 1 and 2.

Ultrasound transducer 10 is constructed to include an interposer (or carrier) 12 that provides a structural and electrical foundation for connection to various other devices that are part of the overall device. For example, interposer 12 may be a printed or other type of circuit board. With this understanding, note that (i) FIG. 1 illustrates a first side $S_1$ of interposer 12; (ii) FIG. 3 illustrates a second side $S_2$, which is the opposite of side $S_1$, of interposer 12; and (iii) FIG. 5 illustrates a partial cross-sectional view across interposer 12.

Returning to FIG. 1, physically attached to side $S_1$ is an ultrasound receiver array 14, which may be constructed as various types of micromachined ultrasonic transducer receiver (MUT) arrays, known and further being developed in the art. In the prior art, MUT arrays are commonly used both to transmit ultrasound waves and then detect their resultant echo; in the preferred embodiments, however, while using this same structure, array 14 is functionally used as an ultrasound receiver (i.e., imager), whereas as discussed below different apparatus is used as an ultrasound transmitter. Array 14 as shown is two-dimensional, that is, having rows and columns of elements. For the illustrated embodiment, various elements by well-known convention are labeled with a coordinate shown as EL(row number, column number). As further detailed below, each element EL(x,y) provides a cavity, shown generally in FIG. 1 as a small square, where the cavity is surrounded by a material from which all the elements are formed; thus, array 14 may be formed by starting with a silicon member (e.g., square or circular) and forming the elements therein. Further, each element typically has a membrane along the bottom of the element cavity that will flex in response to response to receiving an ultrasound wave. In a preferred embodiment, the total number of row and column elements EL(x,y) are the same and equal to x+1, where preferably x is at least 7, and more preferably x is 49 or greater. Moreover, in an alternative embodiment, the number of row elements could differ from the number of column elements. In still another alternative embodiment, array 14 could be linear, whereby its elements are aligned in a single line. And in still another alternative embodiment, array 14 could be annular. Array 14 also may be constructed using various MUT technologies. One example embodiment uses a piezoelectric micromachined ultrasonic transducer (pMUT) as array 14. An alternatively preferred embodiment uses a capacitive micromachined ultrasonic transducer (cMUT), although a tradeoff is expected to include a higher cost of manufacturing. Either pMUT or cMUT may be constructed relative to a (e.g., silicon) wafer using known and developed semiconductor and micromachining fabrication technologies, so that the elements are formed in part from the wafer material, as further described below.

Figure 2:
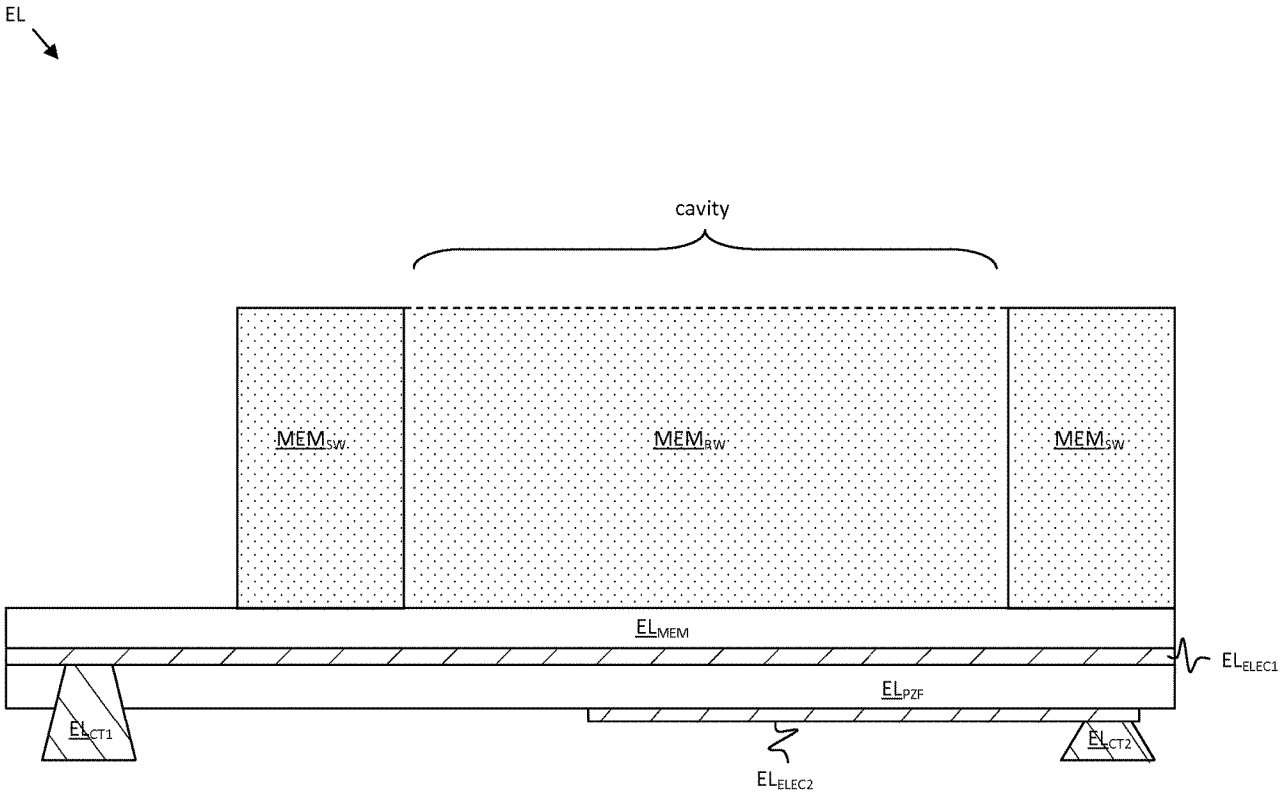
FIG. 2 illustrates an example, in cross-sectional view, of an element EL that may represent any of the various array elements in FIG. 1.

In one preferred embodiment, a plurality of array elements are formed in connection with a semiconductor wafer, with a partial illustration shown in FIG. 2. Specifically, FIG. 2 illustrates an example, in cross-sectional view, of an element EL that may represent any of the various elements in of array 14 in FIG. 1. Element EL includes a semiconductor surrounding a cavity in three-dimensional space, so the cross-sectional view of FIG. 2 illustrates this as two semiconductor sidewall members $MEM_{SW}$ along with a rear wall member $MEM_{RW}$ shown by and below a dashed line; of course, in the illustrated cross-section, the front wall that otherwise would complete the surround around the element is not visible, but is understood as further included, as also visible in FIG. 1. In any event, all such members MEM may be formed or result, for example, by directionally etching from a surface of a semiconductor substrate or wafer, thereby creating respective cavities enclosed by surrounding semiconductor material, referred to herein as sidewall, front wall, and rear wall members for sake of reference. The members MEM are therefore the height of the original semiconductor substrate, with a typical contemporary example being 400 microns. Further therefore, with such a structure, preferably the cavities of each element are generally of the same size and shape. The design of cavity dimensions for acoustic performance is well known in prior art. An element membrane $EL_{MEM}$ is a layer adjacent one end of all the members and contiguous over the cavity. In a preferred embodiment, element membrane $EL_{MEM}$ is in the range of 2 to 10 microns thick and extends across numerous different elements (e.g., across the entire array). Note further, therefore, that in the present and later illustrations, the drawings are not to scale, as the element membrane $EL_{MEM}$ is virtually indiscernible to view, as compared to the 400 microns or so of the members MEM. In any event, preferably, membrane $EL_{MEM}$ is formed as an insulator (e.g., silicon dioxide or silicon nitride), as such materials are common in semiconductor manufacturing. Another preferable attribute of element membrane $EL_{MEM}$, as achieved by the indicated insulator materials, is being inert to chemicals, where such insulators are known to be inert to a variety of common chemicals. Note also that membrane $EL_{MEM}$ is a mechanical structural element that sustains pressure from fluids (e.g., air) that transmit acoustic signals, so for each element, the pressure sustained in the cavity is received by the portion of membrane $EL_{MEM}$ under the cavity.

Adjacent to element membrane $EL_{MEM}$ is a conductive layer providing a first electrode $EL_{ELEC1}$, which is preferably a metal layer in the range of 0.1 to 1 micron thick. First electrode $EL_{ELEC1}$ also is not illustrated to scale, relative to the members MEM. Electrode $EL_{ELEC1}$ also preferably extends across numerous different elements (e.g., across the entire array). Alternatively, each element can have a separate electrode $EL_{ELEC1}$ that is electrically isolated from other elements.

Adjacent to first electrode $EL_{ELEC1}$ is a piezoelectric film layer $EL_{PZF}$, which as its name suggest is a piezoelectric layer, and it is the range of 0.1 to 2 microns thick (also not shown to scale relative to members MEM). Piezoelectric film layer $EL_{PZF}$ also preferably extends across numerous different elements (e.g., across the entire array), but as evident below, its flexure under the cavity of an individual element is represented by electrical signals so as to detect a measure of ultrasound wave receipt by that element. Alternatively, each element can have a disjoint piezoelectric film layer $EL_{PZF}$ so to further isolate electrical signals generated between different elements.

Adjacent piezoelectric film layer $EL_{PZF}$ is a conductive layer providing a second electrode $EL_{ELEC2}$, which is preferably a metal layer in the range of 0.1 to 1 micron thick (also not shown to scale relative to members MEM). Note that second electrode $EL_{ELEC2}$ does not apply across multiple elements, but instead is sized to be less than the cavity for a given cell except for a portion of that electrode that extends beyond the width of the cavity so as to provide an interconnect, as further detailed below. For example, therefore, electrode $EL_{ELEC2}$ may have dimensions in the range of 10% to 80% of the cavity area.

Finally, in one preferred embodiment, a first conductive contact $EL_{CT1}$ may be a metal formed through an opening created in piezoelectric film layer $EL_{PZF}$, so as to reach a portion of first electrode $EL_{ELEC1}$, and a second and separate conductive contact $EL_{CT2}$ is connected to $EL_{ELEC2}$. Thus, first conductive contact $EL_{CT1}$ is provided to electrically communicate first electrode $EL_{ELEC1}$ and a second conductive contact $EL_{CT2}$ is provided to electrically communicate second electrode $EL_{ELEC2}$, as interconnects to an interposer, as detailed below. Note also that electrodes $EL_{ELEC1}$ and $EL_{ELEC2}$ are capacitively coupled.

Given the preceding, in a preferred embodiment and as further discussed below, each element of array 14 is operable to receive an ultrasonic reflection and, due to its structure and materials, provide an electrical signal representative of the received reflection. Toward this end, the first electrode $EL_{ELEC1}$ may be connected to a reference potential such as ground, and the voltage on second electrode $EL_{ELEC2}$ of any element may be electrically sensed relative to the reference, with that difference representing the flexure of piezoelectric film layer $EL_{PZF}$, in response to receiving an ultrasonic wave. Thus, additional circuitry, described below, is connected to separately access each such element so that any combination of respective elements signals may be processed so as to further develop information from the received reflections.

As introduced above, FIG. 3 illustrates side $S_2$ of interposer 12. In a preferred embodiment, physically attached to side $S_2$ are three separate electrical and operational blocks, including a receive (RX) analog-front-end (AFE) 16, an ultrasonic transmitter 18, and a transmit (TX) driver 20. Each of these items is described below.

RX AFE 16 is preferably an integrated circuit and includes analog signal conditioning circuitry, such as operational amplifiers, filters, and the like that provide a configurable electronic functional block for interfacing the analog signals provided by elements in ultrasound receiver array 14 to an external (e.g., digital) circuit, such as an outside processor (e.g., microcontroller, digital signal processor, microprocessor). Thus, RX AFE 16 may couple electrical signals from any array element to an external processor for further processing and analysis.

Figure 4:
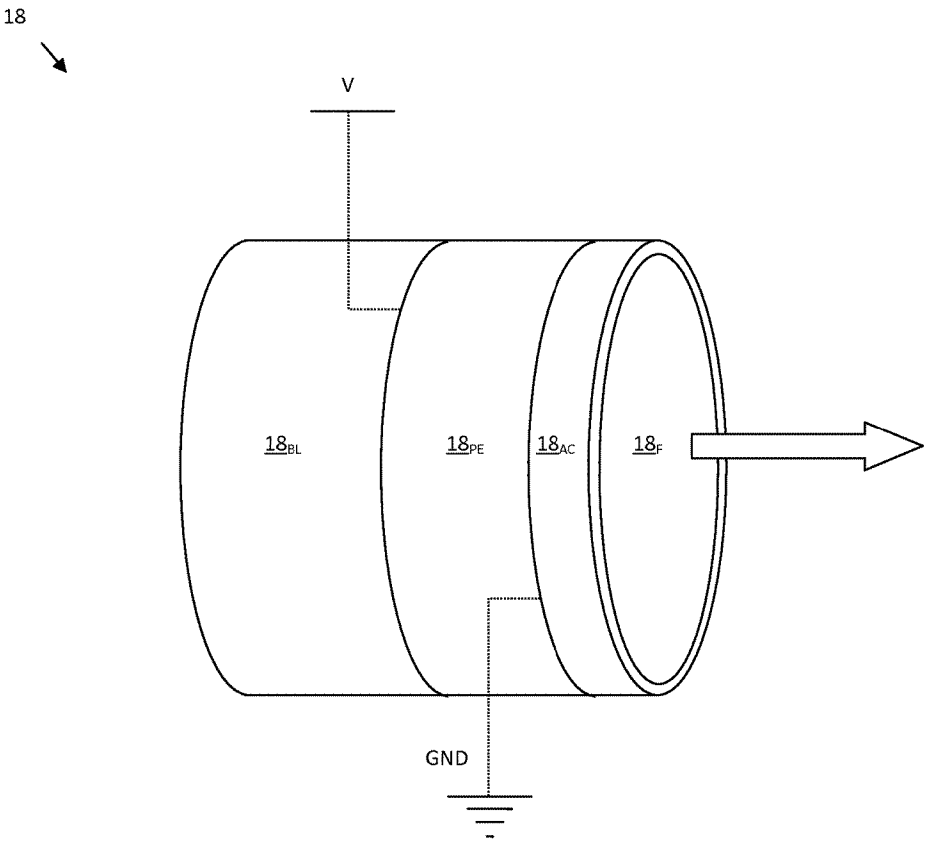
FIG. 4 illustrates a preferred embodiment transmitter.

Transmitter 18 comprises the actuator for generating the ultrasonic sound waves, independent of, and apart from, receiver array 14—that is, while a MUT such as may be implemented in receiver array 14 is used in some prior art as a transmitter, in the preferred embodiments the ultrasonic transmission functionality is provided by independent apparatus. In this regard, transmitter 18 may be constructed from various technologies, known or ascertainable to one skilled in the art. One preferred embodiment of transmitter 18 is shown in a perspective view in FIG. 4. In this example, transmitter 18 is a single element ultrasonic transmitter, preferably constructed using bulk piezoelectric ceramic; in this regard, FIG. 4 illustrates a transmitter with a generally circular cross-section and having a single plate piezoelectric element $\mathbf{18}_{PE}$ made of piezoelectric ceramic, such as lead zirconate titanate (PZT) or single crystal lead magnesium niobate-lead titanate solid solution (PMN-PT), sandwiched by two electrodes to couple to electrical excitations. Optionally, adjacent the front and transmitting side of piezoelectric element $\mathbf{18}_{PE}$ is an acoustic couplant layer $\mathbf{18}_{AC}$, and on the non-transmitting side of piezoelectric element $\mathbf{18}_{PE}$ is backing layer $\mathbf{18}_{BL}$. An electrical difference is applied across piezoelectric element $\mathbf{18}_{PE}$, as shown generally in FIG. 4 with differing bias (e.g., ground and a non-ground voltage, V) at differing positions of the element. In response to this bias, and the thickness and material of piezoelectric element $\mathbf{18}_{PE}$, an ultrasound wave is transmitted toward, and beyond, a face $\mathbf{18}_{F}$ of transmitter 18. Thus, the preferred embodiment implements bulk ceramics for transmitting ultrasound waves, which thereby afford much greater power as compared to certain other types of transmitters, such as if a MUT were used for the transmitter. Specifically, a thicker bulk ceramic can sustain greater voltage and allow more electric power converted through strain energy, as compared to MUT technology.

Returning to and completing FIG. 3, TX driver 20 is included in the preferred embodiment inasmuch as the power and noise requirements are likely to differ as between the lower power needs of RX AFE 16 and the higher power needs of transmitter 18. In this regard, TX driver 20 is preferably an integrated circuit and includes circuitry that provides level shifting as between the lower power available for RX AFE 16 and the higher power needed for transmitter 18. Such level shifting may include control/regulation of current and voltage within a varying range of input voltages.

As also introduced above, FIG. 5 illustrates a cross-sectional view across interposer 12 and other items described above, where additional details are now observed. In a preferred embodiment, each of array 14, RX AFE 16, transmitter 18, and TX driver 20 is physical and electrically interconnected to interposer 12. In one preferred embodiment, each of these items is constructed using bumping metallization or other flip chip bumps such as solder or plated copper so that contacts, such as via miniature ball grid arrays (BGA), may be used to both physically and electrically connect each respective circuit to conductors on interposer 12. In this regard, array 14 is shown to have a respective BGA $\mathbf{14}_{BGA}$ so as to connect to side $S_1$ of interposer 12 to electrodes of array 14, where as shown in FIG. 2 those electrodes include electrode $EL_{ELEC1}$ such as for grounding the entire array and electrode $EL_{ELEC2}$ for each respective element—note to simplify the drawing, such electrodes are not labeled in FIG. 5 (and conductive contact $EL_{CT2}$ is not shown to simplify the drawing). Further, each of RX AFE 16, transmitter 18, and TX driver 20 has a respective BGA $\mathbf{16}_{BGA}$, $\mathbf{18}_{BGAE}$, and $\mathbf{20}_{BGA}$ so as to connect to side $S_2$ of interposer 12. Note that the relatively large number of elements of array 14 will give rise to a shorter pitch and greater connectivity density among BGA $\mathbf{14}_{BGA}$, as compared to that of arrays BGA $\mathbf{16}_{BGA}$, $\mathbf{18}_{BGA}$, and $\mathbf{20}_{BGA}$. For example, the former may be in the range of typically less than 250 microns, or less than 100 microns, or even less than 50 micron, while the latter is in the range of typically greater than 400 microns. Moreover, preferably the BGA (or other connectors) between transmitter 18 and interposer 12 are positioned so as to be out of the path of the acoustic wave transmitted by transmitter 18, which in the orientation of FIG. 5 is upward. Transmitter 18 also may be electrically connected to interposer 12 with other package footprints, such as used in quad flat packages (QFP), quad flat no-leads packages (QFN), or other outline packages such small outline integrated circuit (SOIC), or through-hole connectors.

FIG. 5 also illustrates that an acoustic couplant layer (or multiple layers) $\mathbf{14}_{AC1}$ is formed upward between and vertically beyond the substrate members (i.e., in the cavities) of array 14, and an acoustic couplant layer (or multiple layers) $\mathbf{14}_{AC2}$ is formed between interposer 12 and array 14. Similarly an acoustic couplant layer (or multiple layers) $\mathbf{18}_{AC}$ is formed along transmitter 18 and more specifically on the transmitter surface that faces interposer 12 (recall, such an acoustic couplant layer $\mathbf{18}_{AC}$ is also shown in FIG. 4). Each acoustic couplant layer may be formed by flowing the couplant during a dispense step, while then curing the layer to the positions shown. As known in the art, each such acoustic couplant provides an acoustic matching layer to more readily communicate ultrasonic sounds and sensitivity from the structure to the medium in which transducer 10 is located. Hence, acoustic couplant layer $\mathbf{18}_{AC}$ facilitates the transmission of ultrasonic waves from transmitter 18 in the direction of interposer 12, through array 14, and upward in the perspective of FIG. 5. Similarly, acoustic couplant layer $14_{AC}$ will facilitate the receipt by array 14 of the reflected echo of waves transmitted by transmitter 18. Note further in this regard that array 14 as a pMUT receiver has an additional benefit that both sides of the silicon receiver can serve as a sound port and receive acoustic signals; in contrast, if array 14 is implemented as a cMUT receiver, then preferably it further includes "through silicon via" (TSV) construction to send electric signals from the front side imager to the backside interconnect.

Given the preceding, the general operation of transducer 10 should be readily understood to one skilled in the art. In general, an enabled power supply (e.g., battery, not shown) is provided to transducer 10, and in response TX driver 20 applies sufficient level adjusting so as to drive transmitter 18 with relatively high power. Transmitter 18 then emits ultrasonic waves, that is, sound or other vibrations at an ultrasonic frequency, and such emissions are optimized by way of acoustic couplant $18_{AC}$, in the direction to and through interposer 12 as well as through and beyond array 14. After the passage of a time window for receiving an expected response, receiver array 14, lower-powered yet more resolution-sensitive relative to single-element transmitter 18, receives an echo of the transmitted signal, and the piezoelectric (or capacitive) nature of array 14 converts those echoes into proportional electrical signals. These element signals are then conditioned by RX AFE 16 for further processing, either by circuitry also on interposer 12 or connected via an interface of RX AFE 16.

Given the preferred embodiment construction and operation, various benefits are realized. For example, the use of an array 14 for receiving permits design adjustments for size and pitch determined by resolution needs so as to optimize sensing, while the use of one or more single-element transmitter 18 (as described below) will be sufficient in various applications for focus and/or synthetic aperture transmissions and may be further optimized for transmitting. Thus, each of array 14 and transmitter 18 may be independently optimized so as to adjust its own respective function, with little or no effect on the opposite function of the other. Moreover, the apparatus therefore requires only a relatively higher voltage signal path for the transmitter(s) apparatus/functionality, while a low voltage signal path is sufficient for the receiver apparatus/functionality. As further shown below, additional benefits may be realized in various alternative preferred embodiments.

Figure 6:
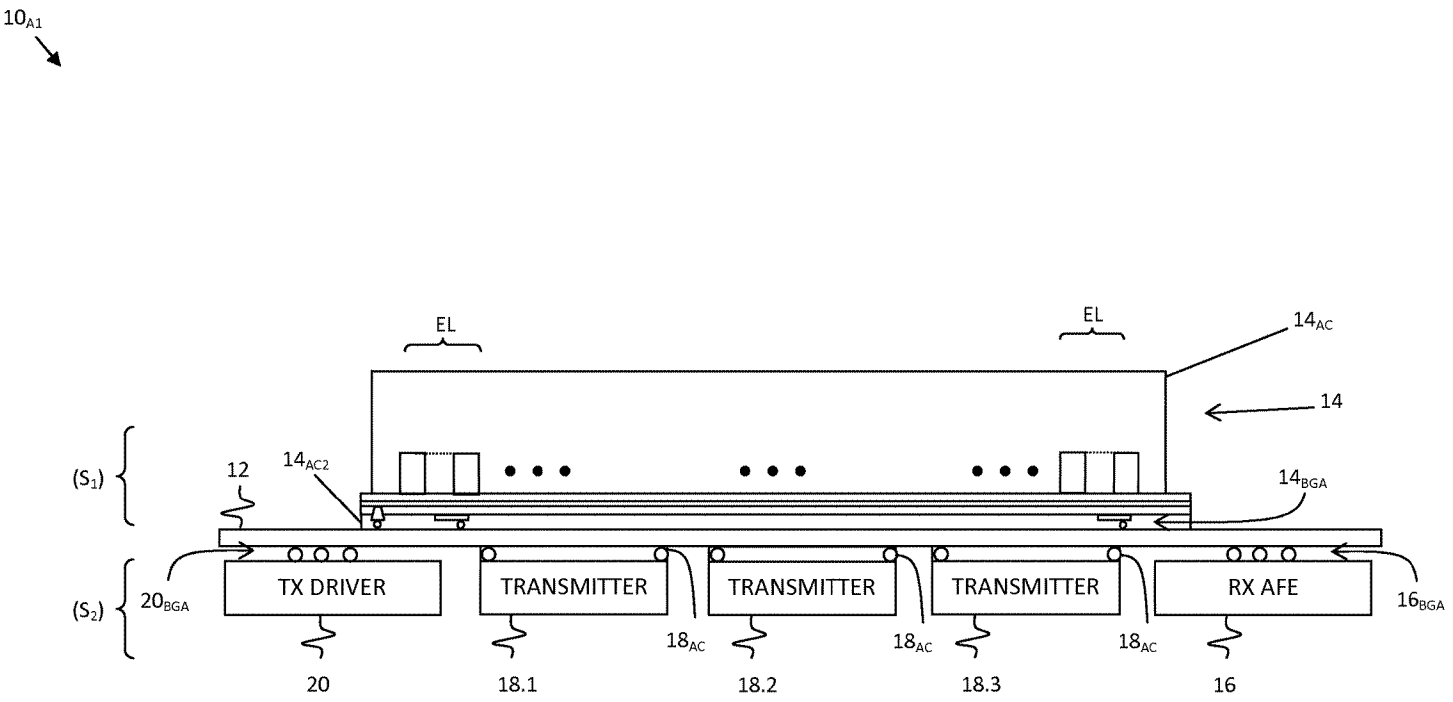
FIG. 6 illustrates a cross-sectional view of a first alternative preferred embodiment ultrasound transducer.

FIG. 6 illustrates a cross-sectional view of an alternative preferred embodiment ultrasound transducer $10_{A1}$. Transducer $10_{A1}$ generally shares much of the same construction and functionality as transducer 10 described above, with the difference that transducer $10_{A1}$ includes a plural number of transmitters, shown in FIG. 4 as preferably three such transmitters, namely, transmitters 18.1, 18.2, and 18.3. Each transmitter 18.*x* is physically and electrically connected to side $S_2$ of interposer 12, in a manner comparable to transmitter 18 for transducer 10. Further, each transmitter 18.*x* in FIG. 4 is preferably a single element transmitter, having a respective acoustic couplant layer $18_{AC}$ along it and facing interposer 12, and electrically each transmitter is connected to interposer 12 via a respective BGA or other formats (not expressly numbered in the Figure).

In general, the operation and functionality of transducer $10_{A1}$ is comparable to transducer 10, whereby each transmitter 18.*x* emits ultrasonic waves in the direction of its respective acoustic couplant, through interposer 12 and into the desired medium; such waves may be reflected by a nearby object, with the echo received and sensed by array 14. In addition, however, note that TX driver 20 (or related circuitry) is operable to excite any or transmitter 18.*x* with controlled phase delay with respect to the other transmitter (s) for beam steering. The echo of such transmissions, as received by array 14, and with signals therefrom communicated via RX AFE 16, may be processed to determine some measure of directionality as a result of beam steering, rather than having a singular direction of emission/detection as in the case of a single transmitter.

Figure 7:
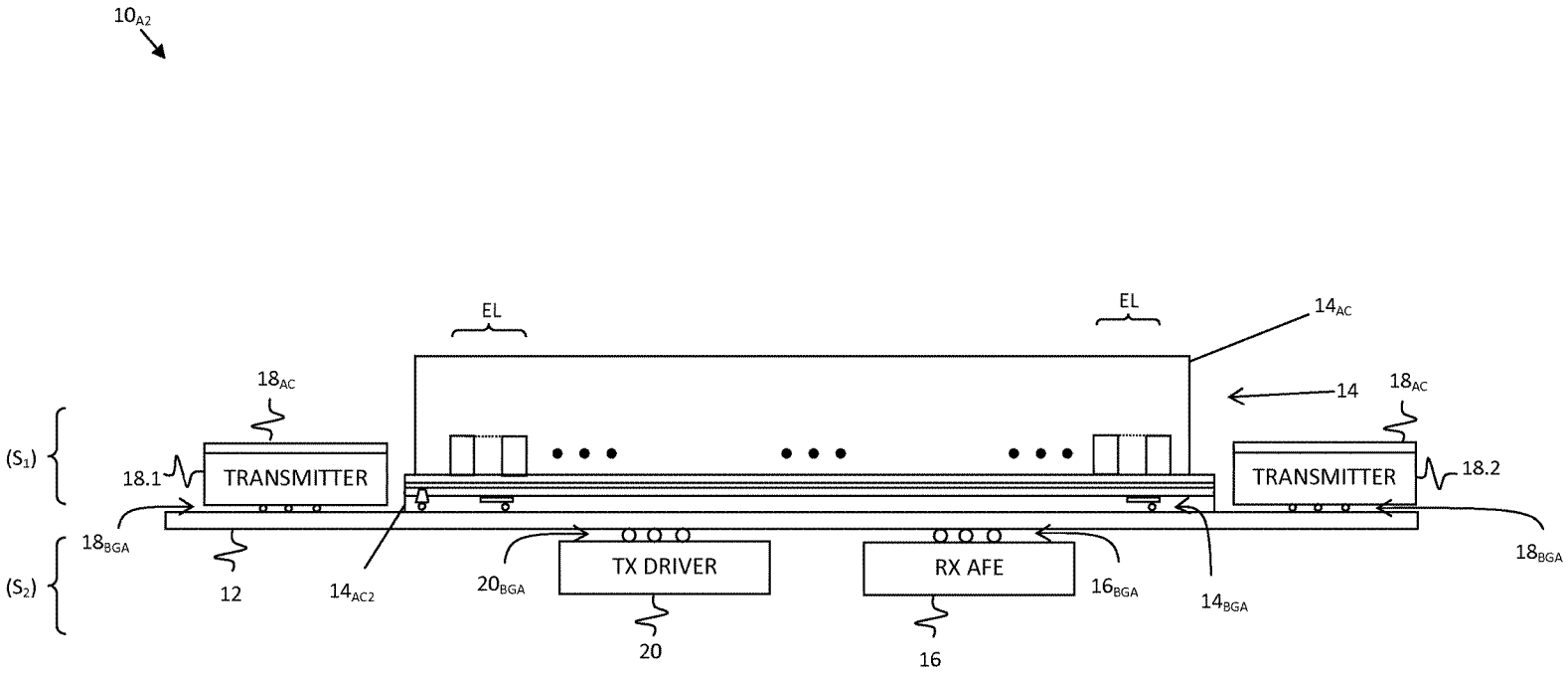
FIG. 7 illustrates a cross-sectional view of a second alternative preferred embodiment ultrasound transducer.

FIG. 7 illustrates a cross-sectional view of an alternative preferred embodiment ultrasound transducer 10. Transducer $10_{A2}$ generally shares much of the same construction and functionality as transducer 10 described above, with the difference that transducer $10_{A2}$ also includes a plural number of transmitters, shown in FIG. 7 as preferably two such transmitters 18.1 and 18.2, and in addition each such transmitter 18.*x* is connected to side $S_1$ of interposer 12. Further in this regard, a respective acoustic couplant layer $18_{AC}$ is formed along a side of each of transmitters 18.1 and 18.2, but in FIG. 7 such layer is on the surface of the transmitter that is opposite of the surface that is electrically connected to interposer 12. Thus, in the perspective of FIG. 5, the lower surface of each transmitter 18.1 and 18.2 is connected, via a respective BGA, to interposer 12, while along the upper surface of each transmitter 18.1 and 18.2 is a respective acoustic couplant layer $18_{AC}$.

In general, the operation and functionality of transducer $10_{A2}$ is comparable to transducer $10_{A1}$, whereby each transmitter 18.*x* emits ultrasonic waves in the direction of its respective acoustic couplant. Note, however, that such emissions for transducer $10_{A2}$ do not pass through interposer 12 (or array 14) and thus, any signal dissipation that otherwise may be caused by such signal passage is avoided. Again, having multiple transmitters allow beam steering. The placement of the transmitters may be important for this purpose. Generally transmitters may be placed at constant spacing for ease of use. For this reason, however, two closely packed transmitters may not offer much advantage, that is, if there are many small transmitters packed tightly, they tend to be smaller and would be limited in power output. In various preferred embodiments, therefore, and for transducer $10_{A2}$, from wave mathematics, larger spacing between point sources allows finer angular resolution.

Figure 8:
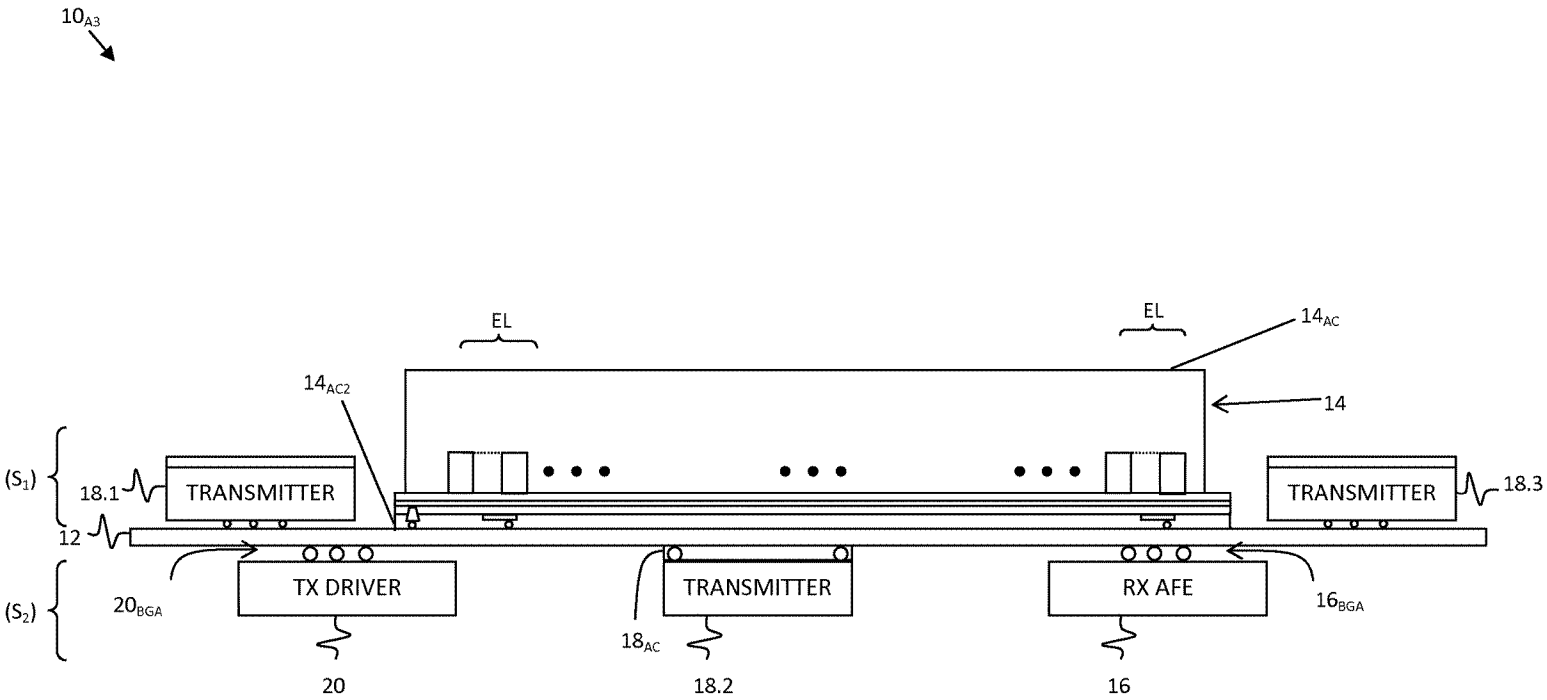
FIG. 8 illustrates a cross-sectional view of a third alternative preferred embodiment ultrasound transducer.

FIG. 8 illustrates a cross-sectional view of an alternative preferred embodiment ultrasound transducer $10_{A3}$. Transducer $10_{A3}$ combines aspects illustrated and discussed above with respect to transducers $10_{A1}$ and $10_{A2}$. Like transducer $10_{A1}$, transducer $10_{A3}$ includes three transmitters 18.1, 18.2, and 18.3. A difference, however, is that two of the transmitters in FIG. 8 are positioned on surface $S_1$, as was the case for transducer $10_{A2}$, while the third transducer is positioned on surface $S_2$, as was the case for the transmitters in transducers 10 and $10_{A1}$. The operation of transducer $10_{A3}$, therefore, should be readily understood to combine aspects described above, with the additional directional resolution of three transmitters, while recognizing that some dissipation of the emission from transmitter 18.2 may occur as its emitted signal is directed through interposer 12 and array 14.

From the above, various preferred embodiments provide improvements to ultrasound transducers by providing such a transducer that combines discrete transmitter circuitry with a micromachined ultrasonic transducer receiver array. The prior art teaches away from such a combination, as contemporary ultrasonic transducers seek to accomplish both transmission and imaging (sensing echo) with a same array, and typically greater sensitivity and resolution is sought by increasing the number of elements in such an array to a great degree. Such efforts increase complexity and cost. Moreover, the use of such arrays may tend to decrease range, given the physical limitations of thin films and small imager elements. In contrast, the preferred embodiments provide numerous benefits. For example, signal processing between transmission and detection can be re-optimized for best transmission beam forming and phase-array imaging. Further, with some AFE modification, in one mode of operation, the MUT can still be used for both receiving signals as well as transmissions, where for such short distances minimum transmission power is required and low voltage drive would be acceptably provided by RX AVE 16. Still further, discrete transmitters provide a high achievable transmitted power, while the array receiver provides a high achievable receiving resolution and integrated signal path. Moreover, the transmit and receive paths are decoupled, thereby providing improved signal integrity and optimized overall system sensitivity by handling transmission and sensing separately, namely, removing the need for transmission by the array to thereby provide the ability to maximize the array receiver sensitivity. Additionally, power is likewise separated so that low voltage may be used with the array to reduce potential noise, maximize individual process capability, and improve potential on-chip coupling problems. Costs in the preferred embodiments are also well managed by implementing a low cost transmitter(s) without complicated machining and a smaller receiver than would be necessary as compared to one necessary to size up to transmit power. Still further, flip chip assembly provides a modest interconnect and assembly complexity. As a result of the preceding, the preferred embodiments may be implemented in numerous applications, such as: (i) high sensitivity finger print sensor; (ii) intra-vascular Ultrasound Sensor with photo acoustic TX or capability; (iii) ultrasound vein detector; or (iv) ultrasound commuted tomography (CT) or micro-CT, wherein the TX element and RX element are not in the same transducer/location.

The preferred embodiments are thus demonstrated to provide an ultrasound transducer combining discrete transmitter circuitry with a separate ultrasonic transducer receiver array. The preferred embodiments have been shown to have numerous benefits, and still others will be further determined by one skilled in the art. Moreover, while various embodiments have been provided, also contemplated are adjustments to various measures and architectures according to application and other considerations. For example, as mentioned earlier, one preferred embodiment may include array 14 as annular in shape; with the various illustrations of alternative transmitter locations, therefore, the annular array could include a transmitter(s) in the middle open area defined by the annulus and/or a transmitter(s) outside the perimeter of the annulus. In this manner, the various transmitters may be used to steer the beam in various x, y, z dimensions. As another example comparable in certain respects to an annulus with a singular open area, another preferred embodiment may include an array with multiple voids, that is, areas where there is no semiconductor member wall material, wherein each such void includes a respective transmitter. As yet another example, while illustrated preferred embodiments depict at least one ultrasonic transmitter and a separate ultrasonic receiver both physically connected to the interposer via their respective electrical contacts, in alternative preferred embodiments the physical connection may be separated from the electrical connection, and/or also may be facilitated by some intermediary structure, where in any event the transmitter is affixed, by some member or apparatus, physically relative to the interposer and also by the same or separate structure coupled to electrically communicate with electrical connectivity contacts of the interposer. Still further, while various alternatives have been provided according to the disclosed embodiments, still others are contemplated and yet others can ascertained by one skilled in the art. Given the preceding, therefore, one skilled in the art should further appreciate that while some embodiments have been described in detail, various substitutions, modifications or alterations can be made to the descriptions set forth above without departing from the inventive scope, as is defined by the following claims.

The invention claimed is:

1. An ultrasonic transducer, comprising:

an interposer having electrical connectivity contacts;

an ultrasonic receiver, comprising an array of receiving elements, physically fixed relative to the interposer and coupled to electrically communicate with electrical connectivity contacts of the interposer; and at least one ultrasonic transmitter, separate from the ultrasonic receiver, physically fixed relative to the interposer and coupled to electrically communicate with electrical connectivity contacts of the interposer.

2. The ultrasonic transducer of claim 1 wherein the array comprises at least 64 elements.

3. The ultrasonic transducer of claim 1 wherein the array comprises a same number of rows and columns of the elements.

4. The ultrasonic transducer of claim 1 wherein the at least one ultrasonic transmitter comprises a single element transmitter.

5. The ultrasonic transducer of claim 1 wherein the at least one ultrasonic transmitter comprises a bulk ceramic transmitter.

6. The ultrasonic transducer of claim 1:

wherein the ultrasonic receiver is physically fixed adjacent a first side of the interposer; and wherein the at least one ultrasonic transmitter is physically fixed adjacent a second side, opposite the first side, of the interposer.

7. The ultrasonic transducer of claim 6 and further comprising a plurality of ultrasonic transmitters, comprising the at least one ultrasonic transmitter, wherein all of the plurality of ultrasonic transmitters are physically fixed adjacent the second side.

8. The ultrasonic transducer of claim 7 and further comprising an acoustic couplant layer adjacent each transmitter and facing the interposer.

9. The ultrasonic transducer of claim 1 and further comprising a plurality of ultrasonic transmitters, comprising the at least one ultrasonic transmitter.

10. The ultrasonic transducer of claim 9:

wherein the ultrasonic receiver is physically fixed adjacent a first side of the interposer;

wherein at least a first ultrasonic transmitter in the plurality of ultrasonic transmitters is physically fixed adjacent the first side; and wherein at least a second ultrasonic transmitter in the plurality of ultrasonic transmitters is physically fixed adjacent a second side, opposite the first side, of the interposer.

11. The ultrasonic transducer of claim 1 and further comprising two ultrasonic transmitters, comprising the at least one ultrasonic transmitter.

12. The ultrasonic transducer of claim 1 and further comprising three ultrasonic transmitters, comprising the at least one ultrasonic transmitter.

13. The ultrasonic transducer of claim 12:

wherein the ultrasonic receiver is physically fixed adjacent a first side of the interposer;

wherein a first ultrasonic transmitter and a second ultrasonic transmitter in the plurality of ultrasonic transmitters are physically fixed adjacent the first side; and wherein a third ultrasonic transmitter in the plurality of ultrasonic transmitters is physically fixed adjacent a second side, opposite the first side, of the interposer.

14. The ultrasonic transducer of claim 1:

wherein the ultrasonic receiver is physically fixed adjacent a first side of the interposer; and further comprising a plurality of ultrasonic transmitters, comprising the at least one ultrasonic transmitter, wherein all of the plurality of ultrasonic transmitters are physically fixed adjacent the first side.

15. The ultrasonic transducer of claim 1:

wherein the ultrasonic receiver is physically fixed adjacent a first side of the interposer; and further comprising operational circuitry for operating at least one of the ultrasonic receiver and the at least one ultrasonic transmitter, the operational circuitry physically fixed adjacent a second side, opposite the first side, of the interposer.

16. The ultrasonic transducer of claim 15 wherein the operational circuitry comprises analog front end circuitry for the ultrasonic receiver.

17. The ultrasonic transducer of claim 15 wherein the operational circuitry comprises driver circuitry for providing a first voltage to the at least one ultrasonic transmitter, the first voltage being greater than a second voltage for operating the at least one ultrasonic receiver.

18. The ultrasonic transducer of claim 1 wherein the ultrasonic receiver comprises a pMUT array.

19. The ultrasonic transducer of claim 1 wherein the ultrasonic receiver comprises a cMUT array.

20. The ultrasonic transducer of claim 1 wherein the interposer comprises:

a first side with a first density of electrical connectivity contacts; and a second side with a second density of electrical connectivity contacts, differing from the first density.

21. The ultrasonic transducer of claim 1 wherein the at least one ultrasonic transmitter comprises an annular shape.

22. The ultrasonic transducer of claim 21:

wherein the annular shape has an open area within an outer annular region, and wherein the at least one ultrasonic transmitter is fixed within the open area.

* * * * *